US012716252B2

(12) United States Patent
Wiener et al.

(10) Patent No.: US 12,716,252 B2
(45) Date of Patent: Aug. 25, 2026

(54) ROOF REPAIR APPARATUS AND METHOD

(71) Applicants: Gregory M. Wiener, Alamo, CA (US); Richard W. Gentry, San Ramon, CA (US); Matthew Taylor Saavedra, Galt, CA (US)

(72) Inventors: Gregory M. Wiener, Alamo, CA (US); Richard W. Gentry, San Ramon, CA (US); Matthew Taylor Saavedra, Galt, CA (US)

(73) Assignee: Gregory M. Wiener, Alamo, CA (US)

( * ) Notice: Subject to any disclaimer, the term of this patent is extended or adjusted under 35 U.S.C. 154(b) by 117 days.

(21) Appl. No.: 18/820,866

(22) Filed: Aug. 30, 2024

(65) Prior Publication Data

US 2026/0062938 A1 Mar. 5, 2026

(51) Int. Cl.
*E04G 23/02* (2006.01)

(52) U.S. Cl.
CPC ..... *E04G 23/0281* (2013.01)

(58) Field of Classification Search
CPC . E04G 23/0281; E04G 23/0203; B29C 73/00; B29C 73/10; Y10T 428/20
USPC ..... 52/514, 514.5
See application file for complete search history.

(56) References Cited

U.S. PATENT DOCUMENTS 3,215,243 A 11/1965 Dickerson
5,204,148 A * 4/1993 Alexander ..... E04D 5/145 52/514
5,447,006 A 9/1995 Zenor
5,452,558 A * 9/1995 Eastin ..... E04D 1/36 405/152
5,925,204 A * 7/1999 Hoffmann, Sr. ..... B29C 73/10 52/514
6,231,949 B1 * 5/2001 Hoffmann, Sr. ..... B29C 73/04 52/514
6,918,219 B1 7/2005 Olson
8,153,220 B2 4/2012 Nebesnak et al.
9,631,383 B1 4/2017 Mathieson
9,758,977 B2 9/2017 Lewis
9,970,206 B1 5/2018 Nobbe et al.
(Continued)

FOREIGN PATENT DOCUMENTS

CA 3147268 A1 7/2018
DE 202005000854 U1 5/2005
DE 202012002565 U1 5/2012

*Primary Examiner* — Brian E Glessner
*Assistant Examiner* — Adam G Barlow
(74) *Attorney, Agent, or Firm* — Young Basile Hanlon & MacFarlane. P.C.

(57) ABSTRACT

A method for repairing a roof includes identifying a compromised shingle having a void. The method includes disconnecting at least a portion of the compromised shingle from an overlapping shingle that overlaps at least a portion of the compromised shingle by breaking a length of a bond that connects the compromised shingle to the overlapping shingle that is proximate the void. The method includes inserting at least a portion of a patch between the compromised shingle and the overlapping shingle to cover the void, in which the patch includes a generally planar substrate and a patch adhesive. The method includes applying a generally downward force to a portion of at least one of the patch or the overlapping shingle to urge at least a portion of the patch adhesive into the void to seal the void.

20 Claims, 6 Drawing Sheets

(56) References Cited

U.S. PATENT DOCUMENTS

| | | | | |
|---|---|---|---|---|
| 2007/0199251 | A1* | 8/2007 | Sieling | E04G 23/0281 52/58 |
| 2008/0148669 | A1 | 6/2008 | Ehrman et al. | |
| 2008/0209835 | A1 | 9/2008 | Margarites | |
| 2009/0022924 | A1 | 1/2009 | Griffin | |
| 2010/0192509 | A1* | 8/2010 | Sieling | E04D 1/36 156/60 |
| 2011/0041446 | A1 | 2/2011 | Stephens et al. | |
| 2018/0112427 | A1* | 4/2018 | Bryan | B32B 1/00 |
| 2018/0283026 | A1* | 10/2018 | Mathieson | B32B 23/10 |

* cited by examiner

ROOF REPAIR APPARATUS AND METHOD

FIELD

The present disclosure relates generally to the field of roof repair, and more specifically, to patches for repairing roofing shingles.

BACKGROUND

Structures are often covered by a roof to protect the structure from environmental conditions. A roof may be comprised of shingles that are placed over the structure in an overlapping configuration such that higher shingles (e.g., shingles more proximate an apex of the roof) overlap portions of adjacent lower shingles (e.g., shingles more distal the apex of the roof). Shingles are sometimes damaged due to falling objects or the like.

SUMMARY

One aspect of the disclosure is a method for repairing a roof that includes identifying a compromised shingle having a void. The method also includes disconnecting at least a portion of the compromised shingle from an overlapping shingle that overlaps at least a portion of the compromised shingle by breaking a length of a bond provided by a shingle adhesive that connects the compromised shingle to the overlapping shingle, in which the length of the bond that is provided by the shingle adhesive is proximate the void. The method also includes inserting at least a portion of a patch between the compromised shingle and the overlapping shingle to cover the void. The patch includes a generally planar substrate and a patch adhesive that is disposed on at least a portion of a top surface and at least a portion of a bottom surface of the substrate. The method also includes applying a generally downward force to a portion of at least one of the patch or the overlapping shingle to urge at least a portion of the patch adhesive that is disposed on the bottom surface of the substrate into the void to seal the void.

Another aspect of the disclosure is a method for repairing a compromised single having a void, in which a portion of the compromised shingle and the void is covered by an overlapping shingle. The method includes disconnecting a portion of the overlapping shingle from the compromised shingle that includes a projected position of the void. The method also includes covering the void with a patch by inserting at least a portion of the patch through the length of the bond connecting the compromised shingle to the overlapping shingle that was separated. The patch includes a substantially rigid plate that has a top surface and a bottom surface. The patch also includes a sealant that is disposed on at least a portion of the top surface and at least a portion of the bottom surface. The method also includes applying a compressive force to the patch to urge the sealant disposed on the bottom surface of the plate at least partially into the void to seal the void.

Another aspect of the disclosure is a patch for repairing a void in a compromised shingle. The void defines an area on the compromised shingle, and the compromised shingle is at least partially covered by an overlapping shingle. The patch includes a generally planar substrate and a deformable sealant. The generally planar substrate is sized to have a surface area that is larger than the area on the compromised shingle defined by the void. The deformable sealant is disposed on a portion of a bottom surface of the generally planar substrate and a portion of a top surface of the generally planar substrate. The deformable sealant is bondable to at least one of an asphalt-type shingle or a composite-type shingle. When the patch is placed over the void, a first portion of the deformable sealant disposed on the bottom surface of the generally planar substrate at least partially extends into the void to seal the void. Furthermore, when the patch is placed over the void, a second portion of the deformable sealant disposed on the bottom surface of the generally planar substrate forms a bond between the generally planar substrate and the compromised shingle. Furthermore, when the patch is placed over the void, a third portion of the deformable sealant disposed on the top surface of the generally planar substrate forms a bond between the generally planar substrate and the overlapping shingle.

DETAILED DESCRIPTION

Figure 1:
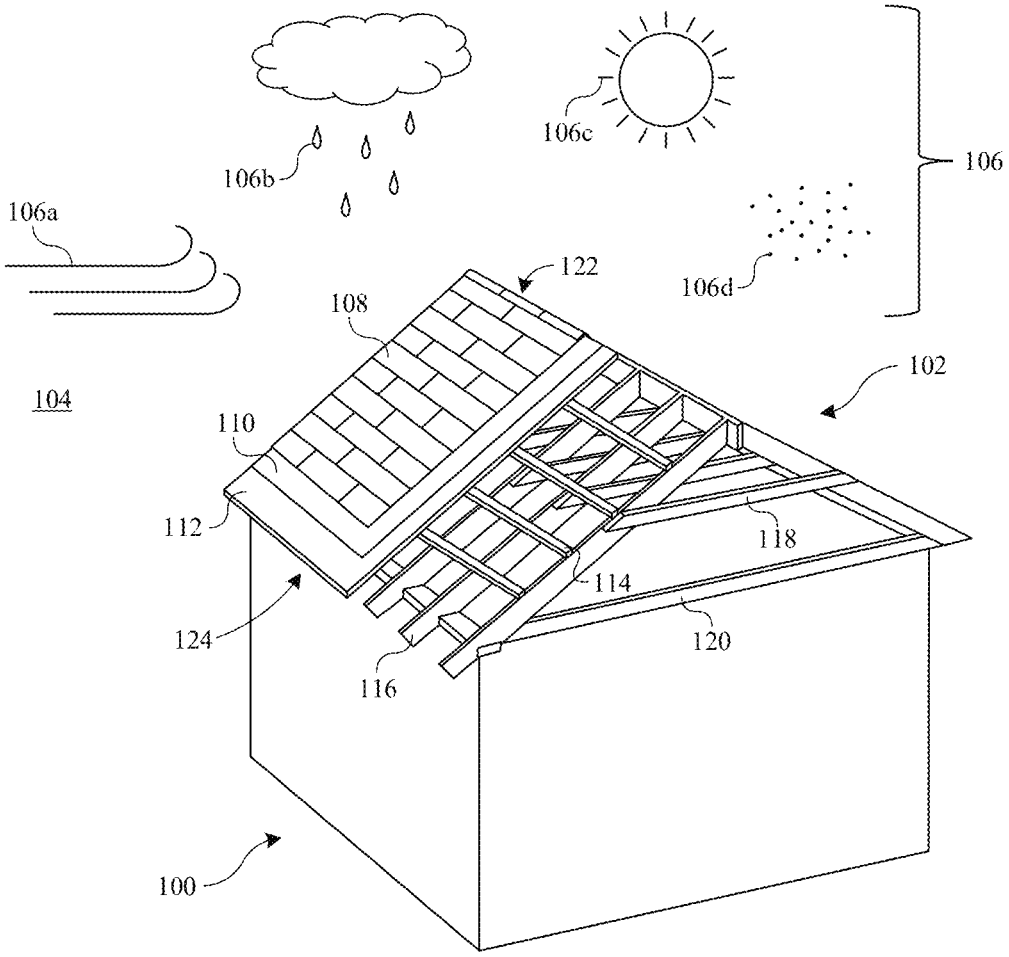
FIG. 1 is a perspective view illustration of a structure including a roof.

The disclosure herein relates to apparatuses and methods for repairing a damaged roof. As described above, structures (e.g., houses, buildings, etc.) are often covered by a roof to protect the structure (e.g., an interior of the structure, a deck of the structure, a garage of the structure, etc.) from conditions of an environment around the structure (e.g., light, water, dust, dirt, debris, etc.). To prevent ingress of such environmental conditions to the structure, roofs often include shingles (e.g., composite-type shingles, asphalt-type shingles, etc.) that are positioned over the structure in an overlapping configuration such that higher shingles (e.g., shingles more proximate an apex of the roof) overlap portions of one or more adjacent lower shingles (e.g., shingles more distal the apex of the roof).

To secure the higher shingles to the one or more immediately adjacent lower shingles in an overlapping configuration, the higher shingles are often connected to the one or more immediately adjacent lower shingles via one or more strips of adhesive that extend along an upper surface of the lower shingle and/or a lower surface of the upper shingle. By connecting the upper shingle to the lower shingle, the upper shingle may be inhibited from lifting due to wind or the like, which may otherwise leave the roof susceptible to further damage and/or enable the environmental conditions to enter the structure. Furthermore, the adhesive may be operable to form a seal (e.g., a partial seal) between the higher shingle and the lower shingle that may further inhibit ingress of the environmental conditions to the structure. The strip of adhesive is often heat-activated and non-reusable after setting.

Shingles are sometimes damaged due to falling objects (e.g., tools, hail, rocks, etc.), activities in the interior of the structure (e.g., drilling into the roof from the interior), or the like. Such damage may be in the form of a hole, a tear, or some other structural defect in one or more shingles, and may be referred to herein as a "void." When a void occurs, environmental conditions may access the structure, resulting in damage to the structure or the contents thereof. For example, water may cause damage to underlayment, sheathing, rafters, floors, walls, some other feature of the structure, or the contents thereof. Accordingly, the void must be remedied (e.g., repaired) to prevent risk of damage resulting therefrom.

To repair a void in the roof, the shingle on which the void is located—referred to herein as a "compromised shingle"—is often replaced. Replacing the compromised shingle typically requires that the bond provided by the strip of adhesive connecting the compromised shingle to a higher shingle located immediately above the compromised shingle—referred to herein as an "overlapping shingle"—be broken to enable access to, and removal of, nails that secure the compromised shingle to the structure. Furthermore, another bond provided by a strip of adhesive connecting the overlapping shingle to a higher shingle located immediately above the overlapping shingle must sometimes also be broken to enable access to, and removal of, other nails that secure the compromised shingle to the structure. Once all the nails that secure the compromised shingle to the structure are removed, the compromise shingle may be removed and replaced with a replacement shingle. Thereafter, the nails are reinstalled to secure the replacement shingle to the structure. However, because the adhesive strip that connects the compromised shingle to the overlapping shingle is often nonreusable, the newly installed replacement shingle often does not form a connection with the overlapping shingle, which may leave the roof susceptible to wind damage or the like. Furthermore, this method of repairing a roof is often time-consuming and expensive due to the cost of related labor and materials (e.g., the replacement shingle, etc.).

Another method often used to repair a void in the roof—which is comparably quicker and less expensive than replacing the compromised shingle—includes filling the void with a sealant. To repair the void that is covered by an overlapping shingle using this method, the bond provided by the adhesive strip that connects the compromised shingle to the overlapping shingle is broken to reveal the void. Thereafter, sealant is applied to the void. However, there are several issues that may result from this method. Firstly, the sealant often does not adequately repair the void and instead falls into the void such that a seal does not form thereover. The risk of the sealant falling into the void rather than forming a seal thereover may increase in proportion to a size of the void. Furthermore, because the sealant often takes an extended period to fully set (e.g., 24 hours), the void may not be monitorable during the full period to ensure that the sealant does not fall into the void and instead forms a seal thereover. Accordingly, this method may not reliably repair the void. Furthermore, like replacing the compromised shingle, this method does not reform the bond provided by the strip of adhesive that connects the compromised shingle to the overlapping shingle, leaving the roof susceptible to wind damage or the like.

The disclosure herein relates to apparatuses and methods for repairing a void in a roof that reliably seals the void while reforming the bond originally provided by the adhesive strip that connects the compromised shingle to the overlapping shingle. The apparatuses and methods disclosed herein include a patch that may be inserted between the compromised shingle and the overlapping shingle to seal the void while requiring minimal interference with the existing roof.

FIG. 1 depicts a structure 100 that includes a roof 102. The structure 100 may be any domestic or commercial construction, or a portion thereof, on which a roof may be included. For example, the structure 100 may be a house, or portion thereof, having a kitchen, a living room, a bedroom, a back-porch, a front-porch, an attached garage, and/or other features and rooms. As another example, the structure 100 may be a detached garage of a house. As another example, the structure may be a commercial building (e.g., office building) having offices, lobbies, garages, and/or other features and rooms.

The structure 100 may include a roof 102 that protects the structure 100 and/or contents thereof from conditions in an environment 104 around the structure 100, which may be referred to herein as environmental conditions 106. For example, the roof 102 may protect the structure 100 from the environmental conditions 106 by inhibiting (e.g., preventing) the environmental conditions 106 from entering the structure 100. As some examples, the environmental conditions 106 may include wind 106*a*, precipitation 106*b* (e.g., rain, snow, etc.), sunlight 106*c*, debris 106*d* (e.g., dust, dirt, leaves, etc.), and the like.

The roof 102 may include, for example, shingles 108, underlayment 110, decking 112, battens 114, trusses 116, collar beams 118, and joists 120. As shown, the collar beams 118 and the joists 120 may extend in a lateral direction across one or more portions of the structure 100 and may support the trusses 116 at an angle relative to a generally flat plane (e.g., a sub-floor of the structure 100). The battens 114 may extend in a longitudinal direction across the trusses 116, such that the battens 114 are orthogonal to the trusses 116. The decking 112 may be supported by the battens 114 and may provide a generally rigid base structure on which the underlayment 110 and the shingles 108 may be positioned. The underlayment 110 may be positioned between the decking 112 and the shingles 108 and may serve several functions depending on its composition, including, but not limited to insulating the structure 100, preventing ice buildup on the roof 102, and shielding the decking 112 and other portions of the roof 102 and/or the structure 100 from the environmental conditions 106. The shingles 108 may be positioned over the underlayment 110 to form an outer surface of the roof 102.

Stated differently, the battens 114, the trusses 116, the collar beams 118, and the joists 120 may cooperatively support the underlayment 110, the decking 112, and the shingles 108 at an angle relative to a flat plane. The angle at which the underlayment 110, the decking 112, and the shingles 108 are supported may be referred to herein as a "pitch" of the roof 102. The pitch of the roof 102 may inhibit (e.g., prevent) the precipitation 106*b*, the debris 106*d*, or the like from accumulating on the roof by encouraging the precipitation 106*b*, the debris 106*d*, or the like to fall off thereof. Furthermore, the pitch may define an apex 122 and a drip edge 124 of the roof 102, in which the apex 122 is located at a top-most portion of the roof 102 and the drip edge 124 is located at a lower-most portion of the roof 102.

The roof 102 may include any number of the shingles 108 depending on the size of the roof 102 and/or the structure 100. As some examples, a smaller size implementation of the structure 100 may include about one thousand of the shingles 108, a medium size implementation of the structure 100 may include about two thousand of the shingles 108, and a large size implementation of the structure 100 may include about three thousand of the shingles 108. Furthermore, the shingles 108 described herein are generally described with respect to architectural-type composite shingles. However, it will be understood that the disclosure herein may be applicable to any suitable type of overlapping shingles (e.g., three-tab shingles, asphalt shingles, etc.).

Figure 2:
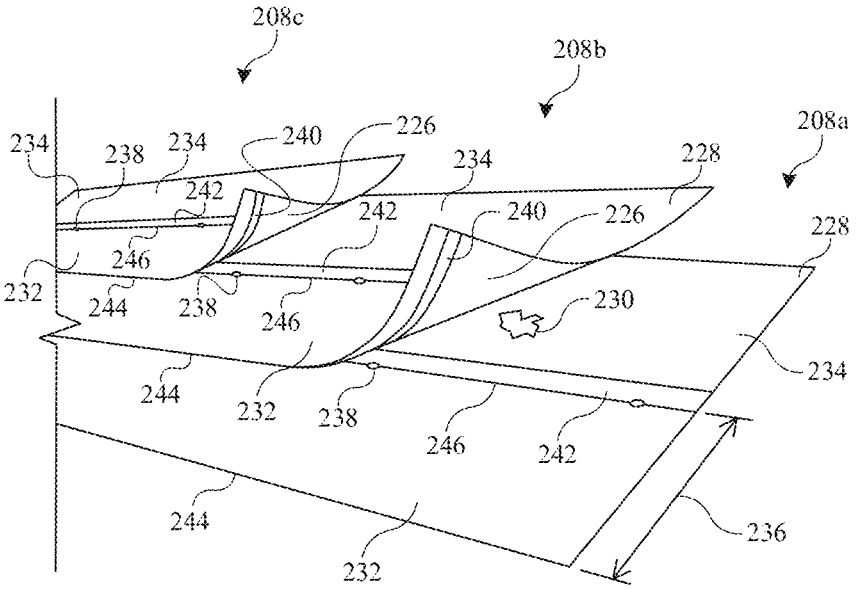
FIG. 2 is a perspective view illustration of a first shingle, a second shingle, and a third shingle in an overlapping configuration.

FIG. 2 depicts an example of three of the shingles 108 in an overlapping configuration, including a first shingle 208*a*, a second shingle 208*b*, and a third shingle 208*c*. For explanation, a lower corner of each of the second shingle 208*b* and the third shingle 208*c* is lifted to reveal a lower surface 226 thereof that is opposite an upper surface 228. The first shingle 208*a* includes a void 230, as explained in further detail below, and may therefore be referred to herein as a "compromised shingle." The second shingle 208*b* overlaps a portion of the first shingle 208*a* and may therefore be referred to herein as an "overlapping shingle." The third shingle 208*c* overlaps a portion of the second shingle 208*b*. As shown, each of the shingles 108 may include an exposed portion 232 and a covered portion 234, in which the exposed portion 232 includes a width 236. The exposed portion 232 of each of the shingles 108 is exposed to the environment 104 and may overlap the covered portion 234 of an immediately adjacent lower one of the shingles 108. For example, as shown, the exposed portion 232 of the second shingle 208*b* may overlap the covered portion 234 of the first shingle 208*a*. Similarly, the exposed portion 232 of the third shingle 208*c* may overlap the covered portion 234 of the second shingle 208*b*. In some implementations, the exposed portion 232 of one of the shingles 108 may overlap the covered portion 234 of multiple (e.g., two) immediately adjacent lower ones of the shingles 108 that are positioned adjacent to one-another along a longitudinally extending row (e.g., course) of the shingles 108.

To achieve an overlapping configuration, lower rows (e.g., courses) of the shingles 108 are typically installed (e.g., secured to the decking 112) prior to installing subsequently higher rows of the shingles 108. To secure the shingles 108 to the decking 112 (see FIG. 1), nails 238 (e.g., roofing nails) may be inserted through one or more of the shingles 108, through the underlayment 110 (if included), and into the decking 112. For example, to install the first shingle 208*a*, one or more of the nails 238 may be inserted through the first shingle 208*a* and into the decking 112. Thereafter, to install the second shingle 208*b*, one or more of the nails 238 may be inserted through the second shingle 208*b*, through the first shingle 208*a* (e.g., the covered portion 234 of the first shingle 208*a*), and into the decking 112. Thereafter, to install the third shingle 208*c*, one or more of the nails 238 may be inserted through the third shingle 208*c*, through the second shingle 208*b* (e.g., the covered portion 234 of the second shingle 208*b*), and into the decking 112.

As explained above, each of the shingles 108 may include an adhesive strip 240 disposed on the lower surface 226 thereof that is configured to form a connection (e.g., a bond) with the upper surface 228 of one or more immediately adjacent lower ones of the shingles 108. For example, as shown, the second shingle 208*b* may include the adhesive strip 240 disposed along the lower surface 226 thereof that is configured to form a connection (e.g., bond) with the upper surface 228 of the first shingle 208*a*. By connecting (e.g., bonding) the lower surface 226 of each of the shingles 108 to the upper surface 228 of immediately adjacent lower ones of the shingles 108, the shingles 108 may be inhibited (e.g., prevented) from lifting due to the wind 106*a* (see FIG. 1) or the like. Furthermore, connecting the lower surface 226 of each of the shingles 108 to the upper surface 228 of immediately adjacent lower ones of the shingles 108, the shingles 108 may form a common structure that inhibits the environmental conditions 106 from damaging the structure 100 and/or the roof 102.

The adhesive strip 240 may be or comprise an asphalt-based composition such as, for example, roofing tar, roofing cement, asphalt-plastic cement, or some other composition. Often, such an asphalt-based composition is heat activated, meaning that the adhesive strip 240 of one of the shingles 108 will not adhere to another one of the shingles 108 until the shingles 108 have been installed and warmed (e.g., by exposure to sunlight). Thereafter, the asphalt-based composition may set to form a bond. Additionally, such an asphalt-based composition is often non-reusable, meaning that the adhesive strip 240 will not adhere to another one of the shingles 108 after initially setting. For example, if the first shingle 208*a* was replaced after the first shingle 208*a* and the second shingle 208*b* had been installed and the adhesive strip 240 of the second shingle 208*b* had set to bond the first shingle 208*a* to the second shingle 208*b*, the adhesive strip 240 of the second shingle 208*b* will often not form a new bond with a replacement shingle that replaces the first shingle 208*a*.

In some implementations, the upper surface 228 of the shingles 108 may be covered with a granule-based coating that may provide protection from ultraviolet radiation and physical damage to the shingle 108, as well as enable persons to stand on the shingles 108 without slipping. However, individual granules often become dislodged from the shingles 108, which may inhibit the adhesive strip 240 from forming a reliable bond therewith. Accordingly, each of the shingles 108 may include a contact strip 242 that is substantially free from the granule-based coating on the upper surface 228 of the shingle 108. By providing a substantially smooth surface that is free from the granule-based coating, the contact strip 242 may enable the adhesive strip 240 to form a reliable bond with the contact strip 242. For example, the contact strip 242 located on the upper surface 228 of the first shingle 208*a* may enable the adhesive strip 240 located on the lower surface 226 of the second shingle 208*b* to bond thereto to connect (e.g., bond) the first shingle 208*a* to the second shingle 208*b*. Similarly, the contact strip 242 located on the upper surface 228 of the second shingle 208*b* may enable the adhesive strip 240 located on the lower surface 226 of the third shingle 208*c* to bond thereto to connect (e.g., bond) the second shingle 208*b* to the third shingle 208*c*. In some implementations, the contact strip 242 may separate the exposed portion 232 and the covered portion 234 of the shingles 108. Furthermore, in some implementations, the width 236 of the exposed portion 232 may be defined between a lower edge 244 of the shingle 108 and the contact strip 242.

In some implementations, the adhesive strip 240 and the contact strip 242 may be reversed, such that the adhesive strip 240 is disposed along the upper surface 228 of each of the shingles 108 to bond the contact strip 242 disposed along the lower surface 226 of an immediately adjacent higher one of the shingles 108. For example, the first shingle 208*a* may include the adhesive strip 240 disposed along the upper surface 228 thereof to bond to the contact strip 242 disposed along the lower surface 226 of the second shingle 208*b*. Similarly, the second shingle 208*b* may include the adhesive strip 240 disposed along the upper surface 228 thereof to bond to the contact strip 242 disposed along the lower surface 226 of the third shingle 208*c*. Where the adhesive strip 240 is disposed on the upper surface 228, the width 236 of the exposed portion 232 of the shingles 108 may be defined between the lower edge 244 of the shingle 108 and the adhesive strip 240.

To encourage consistent placement of the nails 238 through the shingles 108, each of the shingles 108 may also include a visibly apparent nail line 246 that extends along the upper surface 228 of each of the shingles 108. In addition to encouraging consistent placement of the nails 238, the nail line 246 may also be placed such that the nails 238 extend through the nail line 246 and into the covered portion 234 of an immediately adjacent lower one of the shingles 108. Finally, the shingles 108 may be constructed such as to be more robust (e.g., may be thicker) along the nail line 246 to inhibit the nails 238 from becoming dislodged or tearing the shingles 108 over time. In some implementations, the nail line 246 may extend along one or both sides of the contact strip 242 of each of the shingles 108.

As explained previously, the roof 102 may be damaged due to falling objects (e.g., tools, hail, rocks, etc.), activities in the interior of the structure (e.g., inadvertently drilling into the roof 102 from the interior), or the like. The damage may be in the form of holes, tears, or other defects in one or more of the shingles 108, the underlayment 110 (if included) and/or the decking 112, which may be collectively referred to herein as the void 230 in the roof 102. In the illustrated implementation, the void 230 comprises a hole that extends through the upper surface 228 and the lower surface 226 of the covered portion 234 of the first shingle 208*a*. As shown, the void 230 does not extend through the portion (e.g., the exposed portion 232) of the second shingle 208*b* that overlaps the covered portion 234 of the first shingle 208*a*. However, in other implementations, the void 230 may also extend through the portion (e.g., the exposed portion 232) of the second shingle 208*b* that overlaps the first shingle 208*a*.

Typically, to repair the void 230 in the first shingle 208*a*, the first shingle 208*a* is replaced with a non-damaged replacement shingle. To install the replacement shingle, the first shingle 208*a* must first be removed by removing the nails 238 that secure the first shingle 208*a* to the decking. Because the second shingle 208*b* will often overlap the nails 238 that secure the first shingle 208*a* to the decking 112, the second shingle 208*b* must be lifted to enable access to, and removal of, the nails 238. However, because the first shingle 208*a* and the second shingle 208*b* are bonded to one-another via the adhesive strip 240 of the second shingle 208*b*, the bond provided thereby must be broken to enable the second shingle 208*b* to be lifted. Furthermore, as shown in the illustrated implementation, the nails 238 that secure the second shingle 208*b* to the decking 112 also extend through the covered portion 234 of the first shingle 208*a*, and thus also must also be accessed and removed to enable the removal of the first shingle 208*a*. Accordingly, the bond between the second shingle 208*b* and the third shingle 208*c* provided by the adhesive strip 240 disposed on the lower surface 226 of the third shingle 208*c* must be broken to enable the third shingle 208*c* to be lifted to reveal the nails 238. In some implementations, the nails 238 that secure the third shingle 208*c* to the decking 112 may also extend through the covered portion 234 of the first shingle 208*a*, and thus also must be accessed and removed to enable the removal of the first shingle 208*a*. Accordingly, a bond between the third shingle 208*c* and an immediately adjacent higher fourth shingle (not shown) must be broken to enable the fourth shingle to be lifted to reveal the nails 238. Removal of the nails 238 and breaking the bonds provided by the adhesive strip 240 of each of the shingles required to replace the first shingle 208*a* may be time consuming. Furthermore, after breaking the bonds provided by the adhesive strip 240 of each of the shingles 108 required to replace the first shingle 208*a*, a reliable bond may not thereafter be reformed using the adhesive strip 240, which may leave the roof 102 susceptible to wind damage or the like and/or may leave the structure susceptible to damage from the environmental conditions 106.

Another method typically used to repair the void 230 in the first shingle 208*a* includes filling the void 230 with a liquid sealant (e.g., roofing tar, roofing concrete, etc.). To fill the void 230 with the liquid sealant, the void 230 must first be accessed. Where the void 230 is located on the covered portion 234 of the first shingle 208*a*, the bond between the first shingle 208*a* and the second shingle 208*b* provided by the adhesive strip 240 of the second shingle 208*b* must first be broken to provide access to the void 230. Thereafter, the liquid sealant is applied to the void 230, whereby the second shingle 208*b* is re-laid over the void 230 for the liquid sealant to set. However, the liquid sealant often takes an extended period to fully set. Accordingly, because a view of the void 230 is occluded by the second shingle 208*b*, the void 230 may not be monitorable while the liquid sealant sets to ensure that a reliable seal forms over the void 230. Therefore, often, the liquid sealant falls into the void 230 while setting which may prevent the formation of a reliable seal. Accordingly, this method of repairing the void 230 may be unreliable.

Figure 3:
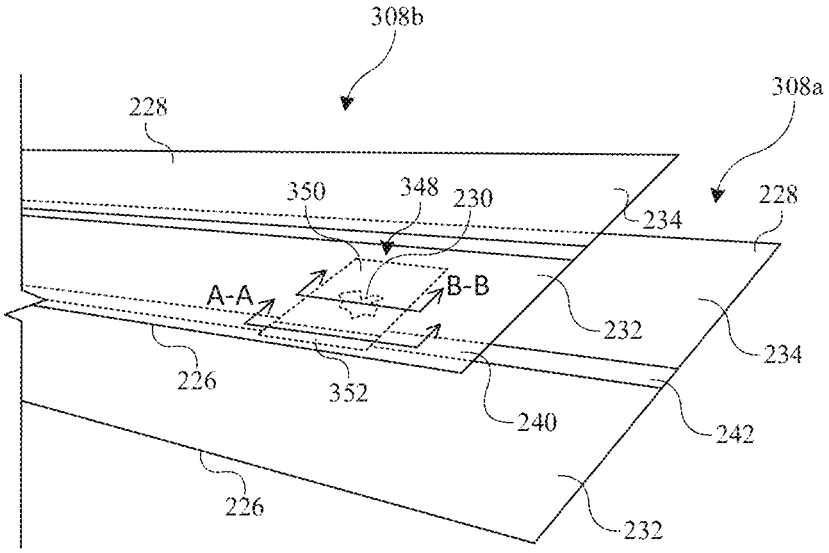
FIG. 3 is a perspective view illustration of a patch inserted between a compromised shingle and an overlapping shingle.
Figure 4A:
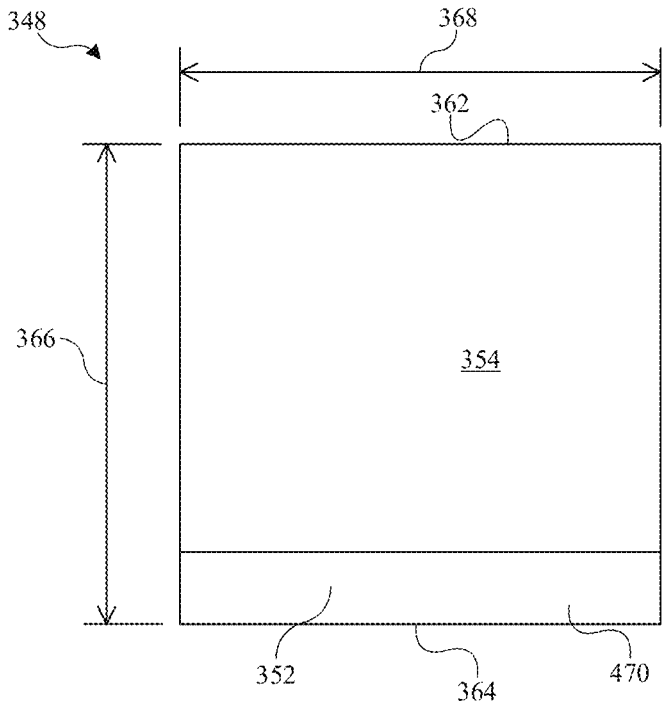
FIGS. 4A-4B are top and bottom view illustrations of the patch of FIG. 3.
Figure 4B:
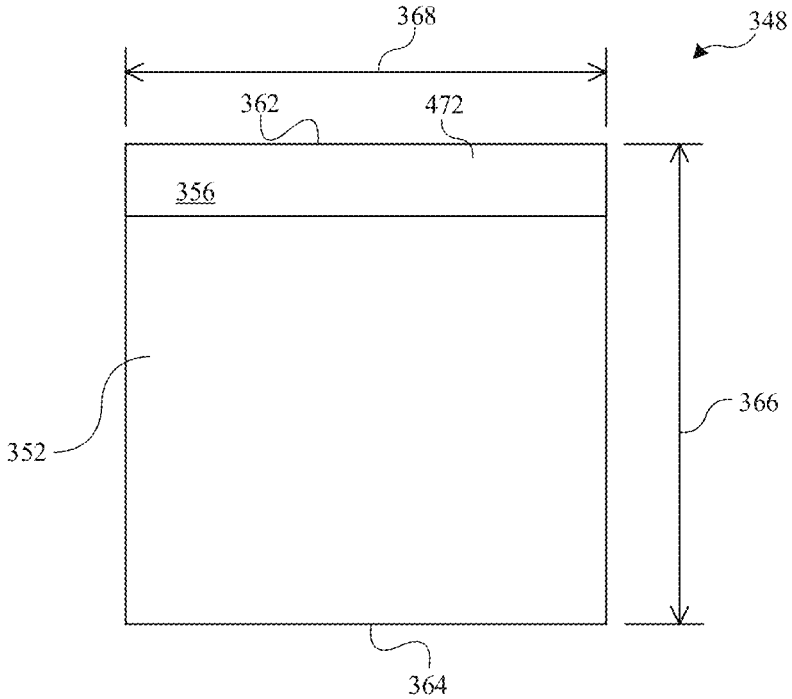

FIGS. 3-4B depict a patch 348 that is configured to remedy (e.g., repair) the void 230 in one or more of the shingles 108. The patch 348 may also be configured to reform the bond provided by the adhesive strip 240 that may be broken to access the void 230. The patch 348 generally includes a substrate 350 and an adhesive 352 that is disposed on at least a portion of a top surface 354 and at least a portion of a bottom surface 356 of the substrate 350. The substrate 350 may be configured to form a structural base over the void 230 while the adhesive 352 may be configured to seal the void 230 and to reform the bond provided by the adhesive strip 240 that may be broken to access the void 230. As best shown in FIG. 3, the first shingle 208*a* includes the void 230 and will be referred to herein as a compromised shingle 308*a*. The second shingle 208*b* overlaps the covered portion 234 of the first shingle 208*a* and will be referred to herein as an overlapping shingle 308*b*. To differentiate between the adhesive strip 240 and the adhesive 352, the adhesive strip 240 may be referred to herein as a "shingle adhesive" and the adhesive 352 may be referred to herein as a "patch adhesive."

Generally, to apply the patch 348, the method of which is described in further detail below with respect to FIG. 6, the compromised shingle 308*a* having the void 230 is identified. *A* width of the substrate 350 is then measured on either the compromised shingle 308*a* or the overlapping shingle 308*b* at location corresponding to that of the void 230. The measured width of the substrate 350 is then used to break (e.g., separate) a length of the bond between the compromised shingle 308*a* and the overlapping shingle 308*b* provided by the adhesive strip 240 of the overlapping shingle 308*b* to allow the patch 348 to access the void 230. The patch 348 is then inserted between the compromised shingle 308*a* and the overlapping shingle 308*b* such that the patch 348 covers the void 230. A force is then applied to the overlapping shingle 308*b* and/or the patch 348 to seal the void 230 and to bond the adhesive 352 to the compromised shingle 308*a* and the overlapping shingle 308*b*, thereby reforming the bond originally provided by the adhesive strip 240 of the overlapping shingle 308*b* that was broken to allow the patch 348 to access the void 230.

The substrate 350 may be generally planar such as to be configured to lay across the upper surface 228 of the shingles 108 and to cover the void 230. As shown, the substrate 350 may be substantially rectangular (e.g., square). However, the substrate 350 may have any other suitable shape (e.g., circular, elliptical, triangular, or some other shape). The substrate 350 may have a front edge 362 (e.g., a "leading edge") and a rear edge 364 (e.g., a "rearward edge") that is opposite the front edge 362. The substrate 350 has a length 366 that is defined between the front edge 362 and the rear edge 364 and a width 368 that is orthogonal to the length 366. The length 366 and the width 368 of the substrate 350 may be selected such as to sufficiently cover common sizes of the void 230 while contacting enough of the upper surface 228 of the compromised shingle 308*a* to form a robust bond therewith and to provide a structural base over the void 230 for supporting the adhesive 352. Stated differently, the substrate 350 may be sized to have a surface area that is larger than an area of the compromised shingle 308*a* that is defined by the void 230. Furthermore, the length 366 of the substrate 350 may be selected based on common sizes of the width 236 (see FIG. 2) of the exposed portion 232 of the shingles 108 to, for example, enable the patch 348 to be installed entirely under the exposed portion 232 of the overlapping shingle 308*b* without interfering with the nails 238 that secure the overlapping shingle 308*b* to the decking 112.

In some implementations, the width 368 of the substrate 350 may be in a range between about 1 inch and 6 inches. In some implementations, the width 368 of the substrate 350 may be in a range between about 1 inch and 4 inches. In some implementations, the width 368 of the substrate 350 may be about 2 inches. Furthermore, in some implementations, the length 366 of the substrate 350 may be in a range between about 1 inch and 6 inches. In some implementations, the length 366 of the substrate 350 may be in a range between about 2 inches and 5 inches. In some implementations, the length 366 of the substrate 350 may be about 4 inches.

As explained above, the substrate 350 may be configured to form a structural base over the void 230, and thus may be substantially rigid (e.g., may have a generally high bending stiffness) to support the adhesive 352 disposed on the bottom surface 356 of the substrate 350. Accordingly, the substrate 350 may also be referred to herein as a "plate." In some implementations, the substrate 350 may be or comprise a metal plate (e.g., a steel plate, an aluminum plate, etc.). In some implementations, the substrate 350 may be or comprise a plate of galvanized steel.

As explained previously, the adhesive 352 is configured to seal the void 230 and to reform the bond provided by the adhesive strip 240 that may be broken to access the void 230. To seal the void 230, a first portion of the adhesive 352 disposed on the bottom surface 356 of the substrate 350 may be configured to deform such as to at least partially extend into the void 230 (e.g., to at least partially fill the void 230) when the patch 348 is placed over the void 230. To reform the bond between the compromised shingle 308*a* and the overlapping shingle 308*b* originally provided by the adhesive strip 240, a second portion of the adhesive 352 disposed on the bottom surface 356 of the substrate 350 may be configured to bond to the upper surface 228 of the compromised shingle 308*a* that surrounds the void 230 when the patch 348 is placed over the void 230, and a third portion of the adhesive 352 disposed on the top surface 354 of the substrate 350 may be configured to bond to the lower surface 226 of the overlapping shingle 308*b* when the patch 348 is placed over the void 230. Accordingly, when the patch 348 is placed over the void 230, the substrate 350 may form a structural base over the void 230 on which the first portion of the adhesive 352 disposed on the bottom surface 356 of the substrate 350 may be supported.

The adhesive 352 may be or comprise a deformable (e.g., liquid) adhesive that is configured to seal the void 230 and that is bondable to materials that form the shingles 108 (e.g., is bondable to composite-type shingles, asphalt-type singles, etc.). The adhesive 352 may also be referred to herein as a sealant (e.g., a deformable sealant). To form a reliable seal over the void 230, the adhesive 352 may have a viscosity that enables the adhesive 352 to deform (e.g., partially deform) and depress (e.g., partially depress, extend, partially extend) into the void 230 upon installation of the patch 348 (e.g., when the patch 348 is placed over the void 230). For example, in some implementations, the adhesive 352 may have a viscosity that is in a range between about 2,000 centipoise and about 4,000 centipoise at seventy-eight degrees Fahrenheit. In some implementations, the adhesive 352 may have a viscosity that is in a range between about 2,500 centipoise and about 3,200 centipoise at seventy-eight degrees Fahrenheit. In some implementations, the adhesive 352 may have a viscosity that is about 2,900 centipoise at seventy-eight degrees Fahrenheit.

In some implementations, the adhesive 352 may comprise a liquid butyl rubber composition (e.g., a copolymer of isobutylene and isoprene combined with hexane). Liquid butyl rubber may be advantageous as the adhesive 352 for several reasons, including being substantially impermeable to air, water, and dust. Furthermore, liquid butyl rubber has relatively high resistances to heat, ultraviolet light, ozone, and/or other of the environmental conditions 106. Liquid butyl rubber is also capable of forming a bond with materials that form the shingles 108 (e.g., composite, asphalt, etc.) and may be capable of forming a bond with the shingles 108 despite the shingles 108 including the granule-based coating as described previously. Furthermore, the viscosity of liquid butyl rubber enables a robust seal to form over relatively large variations of the void 230 by deforming and partially depressing into the void 230 without the butyl rubber detaching from the substrate 350 and falling into the void 230, which may otherwise prevent the formation of a robust seal. Finally, liquid butyl rubber is easily handleable prior to installation, as the liquid butyl rubber may not substantially deform until heated (e.g., by exposure to sunlight) after installation. Although the advantages of liquid butyl rubber have been described, any other adhesive that may form a robust seal over the void 230 while forming a robust bond between the shingles 108 may be used.

Referring to FIG. 4A, the top surface 354 of the substrate 350 may include a strip 470 of the adhesive 352 that is configured to bond to the lower surface 226 of the overlapping shingle 308*b*. As shown, the strip 470 of the adhesive 352 may extend along (e.g., adjacent to) the rear edge 364 of the top surface 354 of the substrate 350 such that the strip 470 of the adhesive 352 is configured to bond to the lower surface 226 of the overlapping shingle 308*b* proximate the lower edge 244 thereof to form a connection (e.g., a bond) between the top surface 354 of the substrate 350 and the lower surface 226 of the overlapping shingle 308*b*. Furthermore, as best shown in FIG. 3, the strip 470 of the adhesive 352 may be configured to form a bond between the top surface 354 of the substrate 350 and the lower surface 226 of the overlapping shingle 308*b* at a location that is offset (e.g., partially offset or completely offset) from the adhesive strip 240 that originally formed the bond between the compromised shingle 308*a* and the overlapping shingle 308*b* that was broken to enable insertion of the patch 348. In some implementations, however, the strip 470 of the adhesive 352 may be configured to form a bond between the top surface 354 of the substrate 350 and the lower surface 226 of the overlapping shingle 308*b* at the location of the adhesive strip 240 that originally formed the bond between the compromised shingle 308*a* and the overlapping shingle 308*b*.

Besides the strip 470 of the adhesive 352 extending along the top surface 354 of the substrate 350 proximate the rear edge 364, the top surface 354 of the substrate 350 may be otherwise free from the adhesive 352. By leaving a majority of the top surface 354 free from the adhesive 352, during insertion of the patch 348, the top surface 354 of the substrate 350, rather than the adhesive 352, may slide along the lower surface 226 of the overlapping shingle 308*b* which may otherwise result in the adhesive 352 becoming contaminated and/or delaminating from the top surface 354 of the substrate 350.

Accordingly, the top surface 354 of the substrate 350 may be free from the adhesive 352 except for the strip 470 of the adhesive 352 located proximate to the rear edge 364 of the substrate 350. In some implementations, for example, the adhesive 352 may cover a minority of a total area of the top surface 354 of the substrate 350. In some implementations, the adhesive 352 may cover a percentage of the total area of the top surface 354 of the substrate 350 that is in a range between about five percent and about forty percent. In some implementations, the adhesive 352 may cover a percentage of the total area of the top surface 354 of the substrate 350 that is in a range between about ten percent and about thirty percent. In some implementations, the adhesive 352 may cover about twenty percent of the total area of the top surface 354 of the substrate 350. As shown, in some implementations, the strip 470 of the adhesive 352 may extend along an entirety of the width 368 of the substrate 350.

Referring to FIG. 4B, the bottom surface 356 of the substrate 350 may be substantially (e.g., entirely) covered by the adhesive 352 to ensure that the adhesive 352 covers an entirety of the void 230 while forming a bond with the upper surface 228 of the compromised shingle 308*a* that surrounds the void 230. However, to enable insertion of the patch 348 between the compromised shingle 308*a* and the overlapping shingle 308*b* without compromising the adhesive 352 and/or the bond between the adhesive 352 and the substrate 350, a strip 472 of the bottom surface 356 of the substrate 350 that extends along (e.g., adjacent to) the front edge 362 thereof may be left uncovered by the adhesive 352. By leaving the strip 472 of the bottom surface 356 of the substrate 350 proximate the front edge 362 free from the adhesive 352, during insertion of the patch 348, the bottom surface 356 of the substrate 350, rather than the adhesive 352, may slide along the upper surface 228 of the compromised shingle 308*a*, which may otherwise result in the adhesive 352 becoming contaminated and/or delaminating from the bottom surface 356 of the substrate 350.

Accordingly, the bottom surface 356 of the substrate 350 may be entirely covered by the adhesive 352 except for the strip 472 of the bottom surface 356 of the substrate 350 located proximate the front edge 362 of the substrate 350. In some implementations, the adhesive 352 may cover a majority of a total area of the bottom surface 356 of the substrate 350. In some implementations, the adhesive 352 may cover a percentage of a total area of the bottom surface 356 of the substrate 350 that is in a range between about sixty percent and about ninety-five percent. In some implementations, the adhesive 352 may cover a percentage of the total area of the bottom surface 356 of the substrate 350 that is in a range between about seventy percent and about ninety percent. In some implementations, the adhesive 352 may cover about eighty percent of the total area of the bottom surface 356 of the substrate 350. As shown, in some implementations, the strip 472 of the bottom surface 356 of the substrate 350 that is free from the adhesive 352 may extend along an entirety of the width 368 of the substrate 350.

In some implementations, the patch 348 may include a film (e.g., a paper film, a wax film, etc.) (not shown) that covers the adhesive 352 to protect the adhesive 352 prior to installation. For example, the film may protect the adhesive 352 from contamination while transporting the patch 348 to the roof 102. In some implementations, a single film may cover the adhesive 352 disposed on the top surface 354 of the substrate 350 and wrap around the rear edge 364 of the substrate 350 to also cover the adhesive 352 disposed on the bottom surface 356 of the substrate 350.

Figure 5A:
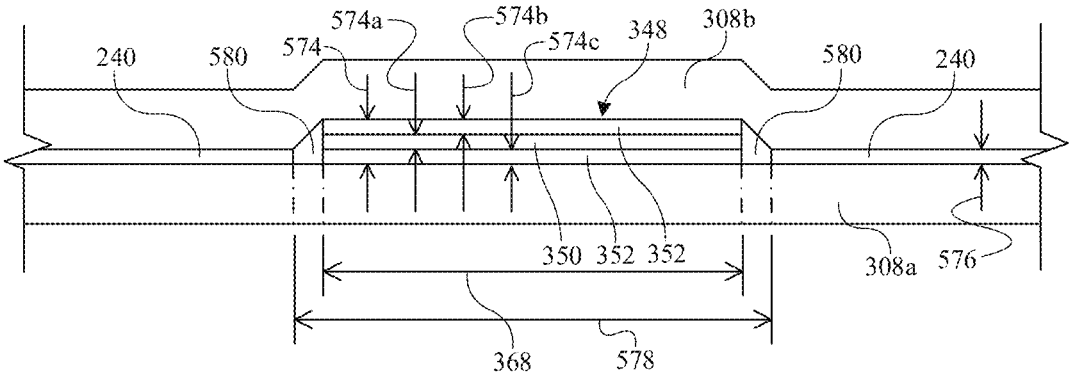
FIG. 5A is a cross-sectional view illustration of the patch installed between the compromised shingle and the overlapping shingle taken along line A-A of FIG. 3.

FIG. 5A is a cross-sectional illustration of the patch 348 inserted between the compromised shingle 308*a* and the overlapping shingle 308*b* taken along line A-A of FIG. 3. In the illustrated implementation, the strip 470 of the adhesive 352 disposed on the top surface 354 of the substrate 350 is configured to form a bond with the overlapping shingle 308*b* at a location that at least partially overlaps with the location of the adhesive strip 240 that is broken to install the patch 348. As shown, due to a combined thickness 574 of the patch 348 being larger than a thickness 576 of the adhesive strip 240, the overlapping shingle 308*b* may be slightly lifted over where the patch 348 is inserted. This may result in a length 578 of the broken bond between the compromised shingle 308*a* and the overlapping shingle 308*b* originally provided by the adhesive strip 240 being slightly larger than the width 368 of the substrate 350. Accordingly, gaps 180 may form on either side of the patch 348, the size of which may increase in proportion to the combined thickness 574 of the patch 348. The combined thickness 574 of the patch 348 includes a thickness 170*a* of the substrate 350, a thickness 170*b* of the adhesive 352 disposed on the top surface 354 of the substrate 350, and a thickness 170*c*, of the adhesive 352 disposed on the bottom surface 356 of the substrate 350.

To reduce the size of the gaps 180, the combined thickness 574 of the patch 348 may be minimized by minimizing the thickness 170*a* of the substrate 350, the thickness 170*b* of the adhesive 352 disposed on the top surface 354 of the substrate 350, and the thickness 170*c* of the adhesive 352 disposed on the bottom surface 356 of the substrate 350 while maintaining their intended functions (e.g., sealing the void 230, reforming the bond between the compromised shingle 308*a* and the overlapping shingle 308*b*, etc.).

As described previously, the substrate 350 may be configured to form a substantially rigid base over the void 230 by which the adhesive 352 disposed on the bottom surface 356 of the substrate 350 may be supported over the void 230. Accordingly, where the substrate 350 is or comprises a plate of steel (e.g., galvanized steel), the thickness 170*a* of the substrate 350 may be in a range between about 0.5 mm and about 2.5 mm. In some implementations, the substrate 350 may have a thickness of about 1.0 mm. Furthermore, to ensure that the adhesive 352 on the top surface 354 and the bottom surface 356 of the substrate 350 form robust bonds with the overlapping shingle 308*b* and the compromised shingle 308*a*, respectively, the thickness 170*b* of the adhesive 352 located on the top surface 354 of the substrate 350 and the thickness 170*b* of the adhesive 352 located on the bottom surface 356 of the substrate 350 may each be in a range between about 0.5 mm and about 2.5 mm. In some implementations, the thickness 170*b* of the adhesive 352 located on the top surface 354 of the substrate 350 and the thickness 170*b* of the adhesive 352 located on the bottom surface 356 of the substrate 350 may each be about 1.0 mm. In some implementations, however, the thickness 170*b* of the adhesive 352 located on the top surface 354 of the substrate 350 may be different than the thickness 170*c* of the adhesive 352 located on the bottom surface 356 of the substrate 350.

Figure 5B:
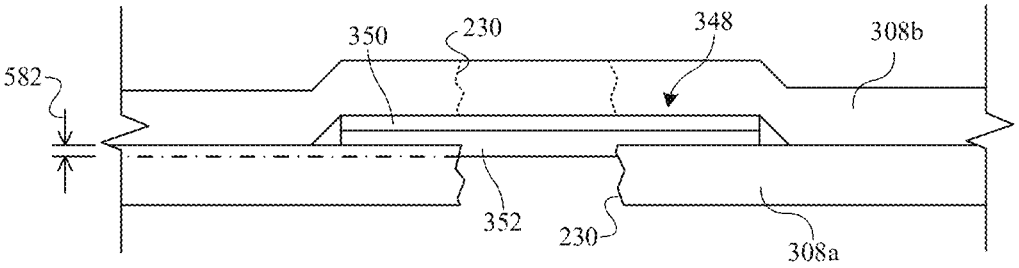
FIG. 5B is a cross-sectional view illustration of the patch installed between the compromised shingle and the overlapping shingle taken along line B-B of FIG. 3.

FIG. 5B is a cross-sectional illustration of the patch 348 inserted between the compromised shingle 308*a* and the overlapping shingle 308*b* taken along line B-B of FIG. 3. As explained previously, the adhesive 352 may be selected such that the adhesive 352 located on the bottom surface 356 of the substrate 350 is configured to deform and depress (e.g., extend) into the void 230 located on the compromised shingle 308*a* to a depth 582 (e.g., when the patch 348 is placed over the void 230). The depth 582 at which the adhesive 352 depresses into the void 230 may depend on the thickness 170*c* and/or the viscosity of the adhesive 352. For example, the depth 582 at which the adhesive 352 depresses into the void 230 may be greater where the adhesive 352 has a lower viscosity and may be lesser where the adhesive 352 has a higher viscosity. In some implementations, for example, the depth 582 may be in a range between about 0.5 mm and about 5.0 mm. In some implementations, the depth 582 may be in a range between about 1.0 mm and about 4.0 mm. In some implementations, the depth 582 may be in a range between about 1.5 mm and about 3.0 mm.

Furthermore, in some implementations, the void 230 may extend through the overlapping shingle 308*b* as well as the compromised shingle 308*a*. In such an implementation, the top surface 354 of the substrate 350 may contact (e.g., abut) the lower surface 226 of the overlapping shingle 308*b* that surrounds the void 230 to form a boundary that may inhibit (e.g., prevent) ingress of the environmental conditions 106 to the structure 100 or other components of the roof 102 (e.g., the compromised shingle 308*a*, the underlayment 110, the decking 112, etc.) through the portion of the void 230 that extends through the overlapping shingle 308*b*.

Figure 6:
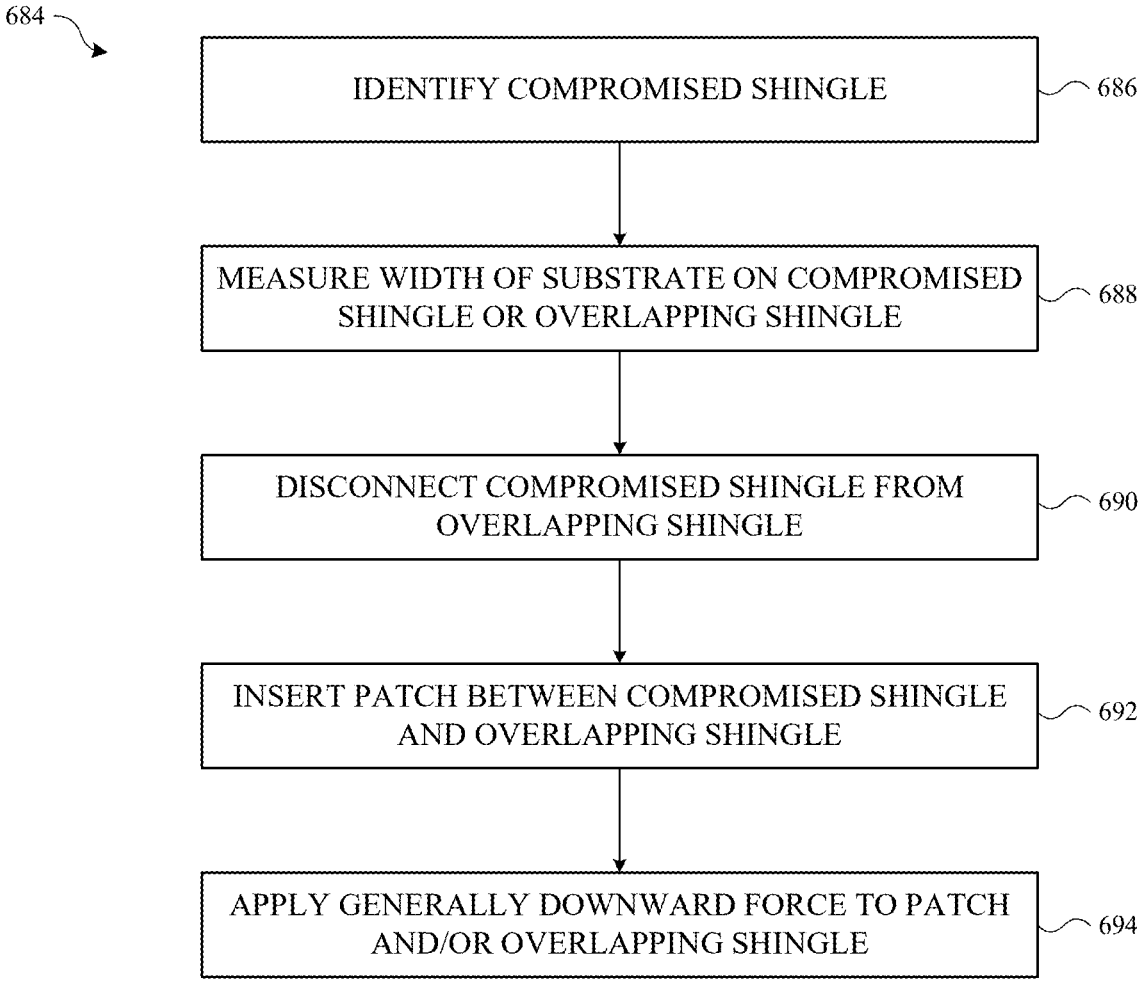
FIG. 6 is a flowchart diagram of a method for repairing a roof using a shingle repair apparatus.

FIG. 6 depicts a flowchart diagram for a method 684 for using the patch 348 to repair the void 230 located on the roof 102. The method 684 may include identifying 686 one of the shingles 108 of the roof 102 on which the void 230 is located (e.g., the compromised shingle 308*a*). Identifying 686 the compromised shingle 308*a* may include visually inspecting the roof 102 for the void 230. In some implementations, the compromised shingle 308*a* may be identified based on having witnessed the event that created the void 230 or may be identified by instruction from another person having witnessed the event.

The method 684 may also include measuring 688 the width 368 of the substrate 350 in relation to the compromised shingle 308*a* and/or the overlapping shingle 308*b*. As explained previously, where the void 230 is located on the covered portion 234 of the compromised shingle 308*a*, the length 578 of the bond (see FIG. 5B) between the compromised shingle 308*a* and the overlapping shingle 308*b* originally provided by the adhesive strip 250 must be broken to enable insertion of the patch 348 between the compromised shingle 308*a* and the overlapping shingle 308*b*. To minimize the size of the gaps 180 (see FIG. 5A), the length 578 of the bond that is broken may be about equal to the width 368 of the substrate 350. Accordingly, the width 368 of the substrate 350 may be measured in relation to the compromised shingle 308*a* and/or the overlapping shingle 308*b*. In some implementations, the substrate 350 may be used as a reference to mark the width 368 of the substrate 350 on the compromised shingle 308*a* and/or the overlapping shingle 308*b*. The marking of the width 368 may be used to indicate the length 578 of the bond originally provided by the adhesive strip 240 of the overlapping shingle 308*b* that must be broken to insert the patch 348. In some implementations, the length 578 of the bond may be proximate the void 230. In some implementations, the length 578 of the bond may include a projected position of the void 230. The projected position of the void 230 may be defined as a projection of the void 230 on the bond provided by the adhesive strip 240 from the void 230 to the lower edge 244 of the compromised shingle 308*a*.

The method 684 may also include disconnecting 690 the compromised shingle 308*a* from the overlapping shingle 308*b*. To disconnect 690 the compromised shingle 308*a* from the overlapping shingle 308*b*, the length 578 of the bond between the compromised shingle 308*a* and the overlapping shingle 308*b* may be broken (e.g., separated). As indicated previously, the width 368 of the substrate 350 measured with respect to the compromised shingle 308*a* and/or the overlapping shingle 308*b* may be used to ensure that the length 578 of the bond that is broken is only as large as necessary to accommodate the width 368 of the substrate 350. In some implementations, disconnecting 690 the compromised shingle 308*a* from the overlapping shingle 308*b* may include lifting the overlapping shingle 308*b* along the length 578 to break the bond between the compromised shingle 308*a* and the overlapping shingle 308*b*. In some implementations, disconnecting 690 the compromised shingle 308*a* from the overlapping shingle 308*b* may include inserting a lever (e.g., a crowbar, a screwdriver, etc.) between the compromised shingle 308*a* and the overlapping shingle 308*b* along the length 578 to break the bond between the compromised shingle 308*a* and the overlapping shingle 308*b*.

The method 684 may also include inserting 692 the patch 348 between the compromised shingle 308*a* and the overlapping shingle 308*b* to cover the void 230. Inserting the patch 348 between the compromised shingle 308*a* and the overlapping shingle 308*b* to cover the void 230 may include inserting the patch 348 through the length 578 of the bond between the compromised shingle 308*a* and the overlapping shingle 308*b* that was broken (e.g., separated) at the disconnecting 690 step. In some implementations, inserting 692 the patch 348 may include sliding the patch 348 between the compromised shingle 308*a* and the overlapping shingle 308*b* such that the strip 472 of the bottom surface 356 of the substrate 350 that is free from the adhesive 352 slides along the upper surface 228 of the compromised shingle 308*a* (e.g., the upper surface 228 of the covered portion 234 of the compromised shingle 308*a*). Furthermore, in some implementations, inserting 692 the patch 348 may include sliding the patch 348 between the compromised shingle 308*a* and the overlapping shingle 308*b* such that the top surface 354 of the substrate 350 that is free from the adhesive 352 slides along the lower surface 226 of the overlapping shingle 308*b* (e.g., the lower surface 226 of the exposed portion 232 of the overlapping shingle 308*b*).

The method 684 may also include applying 694 a generally downward force to the patch 348 and/or to the overlapping shingle 308*b* immediately over the patch 348 to seal the void 230 and to bond the patch 348 to the compromised shingle 308*a* and the overlapping shingle 308*b*, reforming the bond between the compromised shingle 308*a* and the overlapping shingle 308*b* originally provided by the adhesive strip 240 of the overlapping shingle 308*b*. In some implementations, the generally downward force may be or comprise a force applied in a direction that is normal to the upper surface 228 of the overlapping shingle 308*b* at a location of the overlapping shingle that extends over the patch 348. In some implementations, the generally downward force may be or comprise a compressive force applied to the patch 348. For example, by applying 694 the generally downward force to the overlapping shingle 308*b*, a compressive force may be exerted between the overlapping shingle 308*b*, the patch 348, and the compromised shingle 308*a*.

In some implementations, applying 694 the generally downward force to the patch 348 and/or the overlapping shingle 308*b* urges the adhesive 352 disposed on the bottom surface 356 of the substrate 350 into the void 230 to seal the void 230. In some implementations, applying 694 the generally downward force to the patch 348 and/or the overlapping shingle 308*b* results in the adhesive 352 disposed on the bottom surface 356 of the substrate 350 depressing (e.g., extending) at least partially into the void 230 to the depth 582 to seal the void 230. In some implementations, applying the generally downward force to the patch 348 and/or the overlapping shingle 308*b* results in the adhesive 352 disposed on the top surface 354 of the substrate 350 forming a bond between the substrate 350 and the lower surface 226 of the overlapping shingle 308*b*. In some implementations, applying the generally downward force to the patch 348 and/or the overlapping shingle 308*b* results in the adhesive 352 disposed on the bottom surface 356 of the substrate 350 forming a bond between the substrate 350 and the upper surface 228 of the compromised shingle 308*a*. In some implementations, applying 694 the generally downward force to the patch 348 and/or the overlapping shingle 308*b* results in the adhesive 352 located on the bottom surface 356 of the substrate 350 uniformly contacting (e.g., substantially uniformly contacting) the upper surface 228 of the compromised shingle 308*a* to ensure good adhesion of the adhesive 352 to the top surface 354. In some implementations, applying 694 the generally downward force to the patch 348 and/or the overlapping shingle 308*b* results in the adhesive 352 located on the top surface 354 of the substrate 350 (e.g., the strip 470 of the adhesive 352) to uniformly contacting (e.g., substantially uniformly contacting) the lower surface 226 of the overlapping shingle 308*b* to ensure good adhesion of the adhesive 352 to the lower surface 226.

While the disclosure has been described in connection with certain implementations, it is to be understood that the disclosure is not to be limited to the disclosed implementations but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A method for repairing a roof, comprising:

identifying a compromised shingle having a void;

disconnecting at least a portion of the compromised shingle from an overlapping shingle that overlaps at least a portion of the compromised shingle by breaking a length of a bond provided by a shingle adhesive that connects the compromised shingle to the overlapping shingle, wherein the length of the bond is proximate to the void;

inserting at least a portion of a patch between the compromised shingle and the overlapping shingle to cover the void, the patch including:

a generally planar substrate comprising a front edge and a rear edge; and a patch adhesive disposed on: (i) a first portion of a bottom surface of the generally planar substrate, and (ii) a strip located adjacent the rear edge on a top surface of the generally planar substrate, wherein the top surface is otherwise substantially free of the patch adhesive, and wherein a strip adjacent the front edge of the bottom surface is substantially free of the patch adhesive; and applying a generally downward force to a portion of at least one of the patch or the overlapping shingle to urge at least a portion of the patch adhesive disposed on the bottom surface of the generally planar substrate into the void to seal the void.

2. The method of claim 1, wherein applying the generally downward force urges the patch adhesive disposed on the top surface of the generally planar substrate into compressive contact with the overlapping shingle to form a bond between the generally planar substrate and the overlapping shingle and urges the patch adhesive disposed on the bottom surface of the generally planar substrate into compressive contact with the compromised shingle to form a bond.

3. The method of claim 2, wherein forming the bond between the generally planar substrate and the overlapping shingle and forming the bond between the generally planar substrate and the compromised shingle reforms at least a portion of the length of the bond provided by the shingle adhesive that was.

4. The method of claim 1, wherein the length of the bond provided by the shingle adhesive is about equal to a width of the substrate, and wherein applying the generally downward force causes the patch to form a bond between the compromised shingle and the overlapping shingle that replaces at least a portion of the bond that is broken.

5. The method of claim 4, further comprising:

marking the width of the substrate on at least one of the compromised shingle or the overlapping shingle by using the substrate as a reference.

6. The method of claim 1, wherein the patch adhesive comprises liquid butyl rubber.

7. The method of claim 1, wherein the top surface of the substrate is free from the patch adhesive except for a strip of the patch adhesive disposed adjacent to a rear edge of the generally planar substrate that is opposite the front edge of the generally planar substrate, the strip extending across substantially an entire width of the generally planar substrate.

8. The method of claim 7, wherein the bottom surface of the substrate is covered by the patch adhesive except for a strip of the bottom surface disposed adjacent to the front edge of the generally planar substrate, the strip extending across substantially an entire width of the generally planar substrate.

9. A method for repairing a compromised shingle having a void, a portion of the compromised shingle and the void being covered by an overlapping shingle, the method comprising:

disconnecting a portion of the overlapping shingle from the compromised shingle by separating a length of a bond connecting the compromised shingle to the overlapping shingle that includes a projected position of the void;

covering the void with a patch by inserting at least a portion of the patch through the length of the bond connecting the compromised shingle to the overlapping shingle that was separated, the patch including:

a substantially rigid substrate having a top surface and a bottom surface; and a sealant disposed on at least a portion of the top surface and at least a portion of the bottom surface; and applying a compressive force to the substantially rigid substrate to urge the sealant disposed on the bottom surface of the substantially rigid substrate at least partially into the void to seal the void;

wherein the substantially rigid substrate extends along at least a portion of the void and supported the sealant disposed on the bottom surface during application of the compressive force such that the sealant remains adhered and does not detach into the void.

10. The method of claim 9, wherein the length of the bond connecting the compromised shingle to the overlapping shingle is about equal to a width of the substantially rigid substrate.

11. The method of claim 9, wherein covering the void with the patch includes:

sliding a strip of the bottom surface of the substantially rigid substrate that is free from the sealant along an upper surface of the compromised shingle.

12. The method of claim 11, wherein a majority of a total area of the bottom surface of the substantially rigid substrate is covered by the sealant except for the strip of the bottom surface that is free from the sealant, the strip extending adjacent to a front edge of the substantially rigid substrate that is opposite a rear edge.

13. The method of claim 12, wherein the strip of the bottom surface that is free from the sealant extends along an entirety of a width of the substantially rigid substrate.

14. The method of claim 9, wherein covering the void with the patch includes:

sliding a portion of the top surface of the substantially rigid substrate that is free from the sealant along a lower surface of the overlapping shingle.

15. The method of claim 14, wherein a majority of the top surface of the substantially rigid substrate is free from the sealant except for a strip of the sealant disposed adjacent to a rear edge of the substantially rigid substrate that is opposite a front edge.

16. The method of claim 15, wherein the strip of the sealant extends along an entirety of a width of the substantially rigid substrate.

17. A method for repairing a shingle having a hole that is covered by an overlapping shingle, the method comprising:

separating a portion of an adhesive bond between the shingle and the overlapping shingle, the separated portion being located directly above the hole;

lifting the overlapping shingle along the separated portion of the adhesive bond;

inserting a patch between the shingle and the overlapping shingle through the separated portion of the adhesive bond, the patch including:

a substantially rigid, generally planar substrate having a top surface, a bottom surface, a front edge, and a rear edge, the substrate sized such that the substrate extends across at least a portion of the hole;

a sealant disposed on a majority of the bottom surface of the substrate while a strip adjacent the front edge of the bottom surface is substantially free of the sealant; and a strip of the sealant disposed on the top surface adjacent the front edge while a portion of the top surface is substantially free of the sealant;

sliding the substrate between the shingle and the overlapping shingle such that the front edge and the portions substantially free of sealant contact the shingles during insertion; positioning the substrate so that the substrate lays across the hole; and applying a generally downward force to the overlapping shingle over the substrate so that: (i) at least some of the sealant on the bottom surface at least partially enters the hole while remaining adhered to and supported by the rigid substrate, (ii) at least some of the sealant on the bottom surface bonds the substrate to the shingle, (iii) at least some of the sealant on the top surface bonds the substrate to the overlapping shingle, and (iv) the rigid substrate supports at least some of the sealant over the hole such that the supported sealant does not detach from the substrate into the hole.

18. The method of claim 17, wherein the substrate is sufficiently rigid such that, when positioned to lay across the hole and the generally downward force is applied, the substrate forms a structural base over the hole on which the sealant disposed on the bottom surface is supported.

19. The method of claim 17, wherein a minority of a total area of the top surface of the substrate is covered by the sealant and a majority of a total area of the bottom surface of the substrate is covered by the sealant.

20. The method of claim 17, wherein the sealant has a viscosity in a range between about 2,500 centipoise and about 3,200 centipoise at seventy-eight degrees Fahrenheit.

* * * * *